US006050117A

United States Patent [19]

Weyerstall

[11] Patent Number: 6,050,117

[45] Date of Patent: Apr. 18, 2000

[54] MOTOR VEHICLE DOOR LOCK OR THE LIKE

[75] Inventor: Bernd Weyerstall, Wuppertal, Germany

[73] Assignee: Robert Bosch GmbH, Stuttgart, Germany

[21] Appl. No.: 09/051,541

[22] PCT Filed: Sep. 27, 1996

[86] PCT No.: PCT/DE96/01857

§ 371 Date: Apr. 13, 1998

§ 102(e) Date: Apr. 13, 1998

[87] PCT Pub. No.: WO97/13942

PCT Pub. Date: Apr. 17, 1997

[30] Foreign Application Priority Data

Oct. 13, 1995 [DE] Germany ..... 195 38 042
Dec. 7, 1995 [DE] Germany ..... 195 45 722

[51] Int. Cl.[7] ..... E05B 47/00

[52] U.S. Cl. ..... 70/277; 70/279.1; 292/201; 292/337

[58] Field of Search ..... 70/275, 264, 277–279, 70/466; 292/201, 216, 280, 337, 341.12, 341.14, DIG. 23, 38, 42, 43, 54, 65

[56] References Cited

U.S. PATENT DOCUMENTS

| | | | |
|---|---|---|---|
| 4,679,836 | 7/1987 | Pupillo et al. | 292/216 |
| 4,898,414 | 2/1990 | Yamada | 292/337 |

FOREIGN PATENT DOCUMENTS

| | | |
|---|---|---|
| 0 099 820 | 2/1984 | European Pat. Off. . |
| 0 153 231 | 8/1985 | European Pat. Off. . |
| 0 510 843 | 10/1992 | European Pat. Off. . |
| 0 589 158 | 3/1994 | European Pat. Off. . |
| 11 42 525 | 1/1963 | Germany . |
| 19 64 260 | 10/1970 | Germany . |
| 40 31 843 | 4/1991 | Germany . |
| 42 28 235 | 3/1994 | Germany . |
| 189361 | 9/1988 | Hungary . |
| 193976 | 9/1989 | Hungary . |
| 2 240 583 | 8/1991 | United Kingdom . |

OTHER PUBLICATIONS

Smart Card—Good Bye to the Auto Key, Siemens Magazine, Special Edition "Special FuE", Spring 1995, pp. 24–27.

*Primary Examiner*—Suzanne Dino Barrett
*Attorney, Agent, or Firm*—Sixbey, Friedman, Leedom & Ferguson; David S. Safran

[57] ABSTRACT

The object of the invention is a motor vehicle door lock with an outer housing (11) with an entry slot (12) for a lock hinge (50), with a rotary bolt (13) moving in entry slot (12) and located in housing (11), with a lock pawl (14) holding rotary bolt (13) in locked position and placed in housing (11) and preferably with an electric drive (15) placed in housing (11) for lock pawl (14). This is first characterized in that housing (11) is completely closed externally except for entry slot (12) for the lock hinges and optionally entry fittings (23) for one or two Bowden cables (24; 25) and/or an entry fitting (26) for a lock cylinder. Further, it can also and independently be achieved that another drive motor be placed in housing (11) for motorized movement of rotary bolt (13) and that it be engaged with rotary bolt (13) even when the latter is in the locked position, and rotary bolt (13) is turned increasingly further in the locking direction as the motor vehicle speed increases. Especially significant is also a variant of the motor vehicle door lock in which housing (11) is made essentially symmetrical to its central plane lying in or parallel to the plane of rotary bolt (13) and lock pawl (14) and is provided with an entry slot (12) on both large faces parallel to the central plane.

17 Claims, 13 Drawing Sheets

MOTOR VEHICLE DOOR LOCK OR THE LIKE

BACKGROUND OF THE INVENTION

1. Field of the Invention

The invention relates to a motor vehicle door lock or the like with an outer housing with an entry slot for a lock hinge, a rotary bolt that moves in the entry slot, a lock pawl that holds the rotary bolt in a locked position and an electric drive for the for the lock pawl.

2. Description of Related Art

The known motor vehicle door lock on which the invention is based (EP-A-0 589 158) is characterized in that it functions without a key-operated lock cylinder and has a simple design with few mechanical parts. In this motor vehicle door lock only the essentially necessary parts are located in the outer housing, notably rotary bolt, lock pawl and electric drive. Here the rods usual up to now can be eliminated because of the purely electrical control of the drive for the lock pawl. Operating ease is high because of the electrical opening from outside and inside, assembly costs are low. Numerous functions are combined in a simple way in this known motor vehicle door lock. The closed system is overall quite strong for transport to the assembly site, it has fewer individual parts and is easy to build, antitheft protection (protection from opening from the inside when a window pane is destroyed) can be easily made electronically, namely simply by interrupting the control of the electric drive, correspondingly, electric child-proofing is easy to integrate.

Emergency operation is achieved by a reserve battery and controlled by a crash sensor. Optionally also to provide additional mechanical unlocking, which takes into consideration complete stopping of all electrical components, cable pulls can be used in this known motor vehicle door lock. They engage exposed carrying elements of a bent metal carrying plate.

It is also known in the art (DE-A-42 28 235) to coordinate the lock pawl with an antitheft lever which, in the engaged position, blocks the lock pawl for its part in its engaged position. Thus it is avoided that the lock pawl can be raised or pushed away from the outside, for example by a hole made purposely in the outer door panel. This cannot happen either through the necessarily open entry slot for the lock hinge.

A fundamental concept applies to electronic control of motor vehicle door locks in general and we refer to its contents here ("Smart Card—Good Bye to the Auto Key" Siemens Magazine, special edition "Special FuE," Spring 1995, pages 24–27). The modified door handle and lock mechanics mentioned in this concept are not explained further there, they reflect on the above-mentioned concept or similar concepts.

The above-mentioned concept of a motor vehicle door lock is in many respects oriented toward modern and future-oriented requirements of motor vehicle door locks, but still leaves room for further improvements.

SUMMARY OF THE INVENTION

The concept known from the prior art on which the invention is based, that of minimizing mechanical components of a motor vehicle door lock and of replacing the mechanical tumbler system and the various levers by a suitable electronic control, is optimized according to the teaching of the invention by encapsulating the outer housing as much as possible. This results in comprehensive antitheft protection, since the inside of the housing, i.e., especially the lock pawl, is protected from theft. The complete sealing of the interior of the housing gives comprehensive protection against moisture. This is made possible by exploiting the fact that electrical strip conductors can be conveyed, sealed, directly through the housing wall to electrical connection devices. Thus what remains is only the entry slot of the lock hinge, which can also be sealed with measures known from the prior art, as necessary.

If it is desired to have supplemental mechanical operation of the lock pawl, for security reasons or because certain countries require it, then here a concept suitable for sealing and with entry fittings for Bowden cables is included. Finally, a lock cylinder can be integrated directly with a trunk lid, for example, if a suitable entry fitting for the lock cylinder is placed on the housing.

Rounding out the considerations regarding antitheft protection, an additional antitheft lever is allocated to the lock pawl. The lever can be driven by the drive for the opening movement of the lock pawl itself, namely by an opposite movement of this drive.

Since, according to the concept of the invention, all the electric drive components for the lock pawl are located in the housing anyway or a suitable electric drive unit is provided for the rotary bolt, a solenoid can easily be accommodated there that keeps the lock pawl constantly raised when the rotary bolt is open, so that the otherwise usual noise is reduced.

If a (optionally also another) drive motor for motorized movement of the rotary bolt (closing aid, optionally also opening aid) is integrated into the housing of the motor vehicle door lock according to the invention, it can be made to interact permanently with the rotary bolt, controlled specifically so that with increasing travel speed of the motor vehicle the rotary bolt is increasingly turned further in the locking direction. This entrains the lock hinge and results in the contact pressure of the door being further increased as a function of travel speed. Thus whistling noises finally become a thing of the past at high speeds.

The symmetry of the housing with two entry slots for the lock hinge makes it possible to use the motor vehicle door lock according to the invention alternately for left entry, right entry (middle entry for trunk lid, trunk door). Thus also smaller series can be economically produced since the total quantity of the motor vehicle door lock of the needed type doubles or is multiplied.

A further teaching of the invention is concerned with the emergency opening of the motor vehicle door lock that is necessary for safety reasons. Here a pyrotechnic attachment is proposed. Pyrotechnic emergency operation is known, for example, from belt tighteners.

Below the invention is explained in more detail based on a drawing representing only one embodiment.

BRIEF DESCRIPTION OF THE DRAWINGS

FIG. 1 shows a closing and central locking system for a motor vehicle that is controlled electronically as much as possible. This is represented in section.

DETAILED DESCRIPTION OF THE PREFERRED EMBODIMENTS

Figure 1:
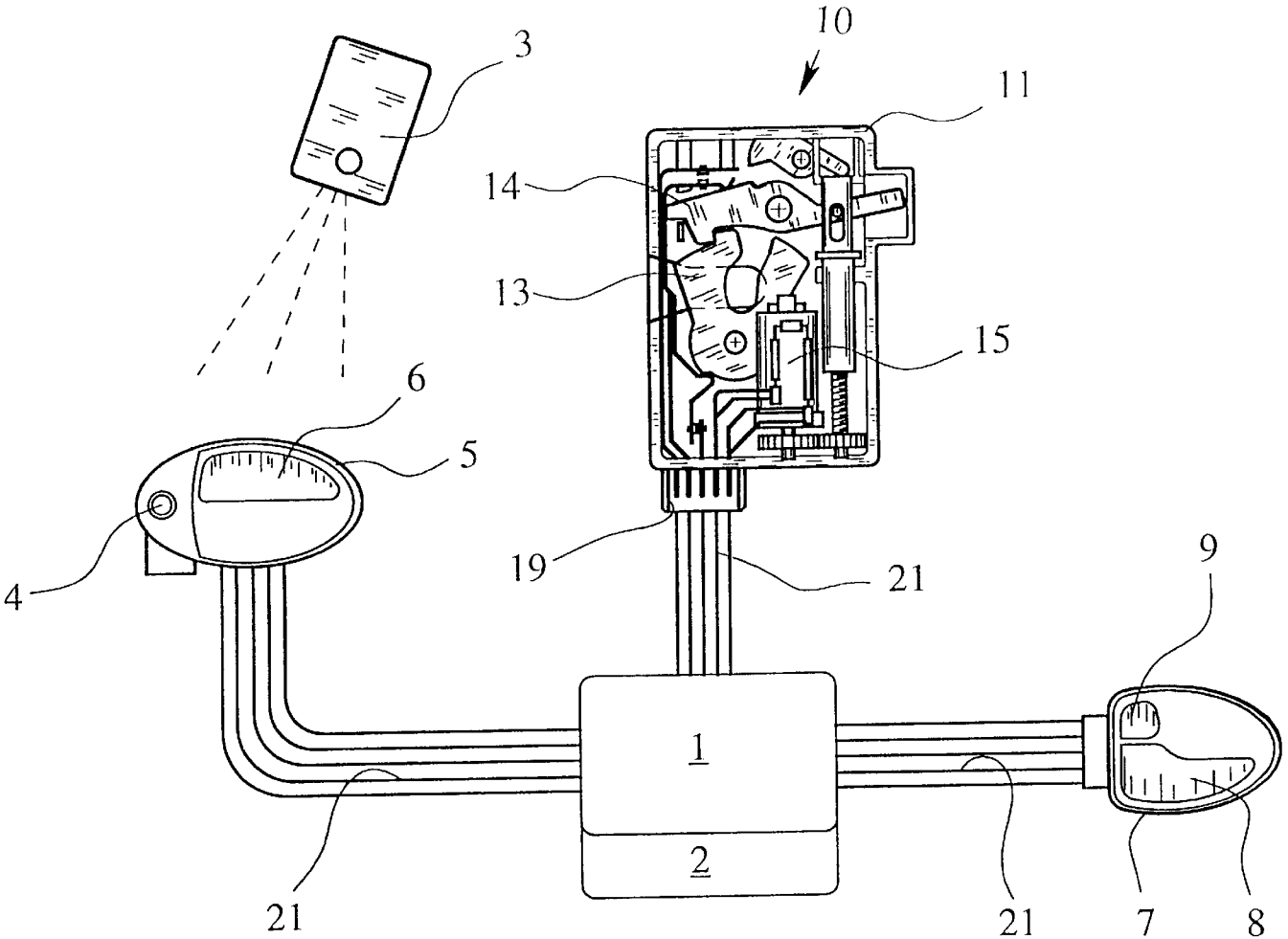
FIG. 1, a diagrammatic representation of a door closer of a motor vehicle according to the concept of the invention, FIG. 2, the motor vehicle door lock of the closer from FIG. 1, FIG. 3, an embodiment of a rear door lock for a motor vehicle in a modified embodiment, FIG. 4, an embodiment of a driver's door lock of a motor vehicle according to the invention, equipped with additional mechanical operation by Bowden cables, FIG. 5, in diagrammatic representation, another embodiment of a motor vehicle door lock according to the invention equipped for controlling the contact pressure of the door as a function of travel speed, FIG. 6, in a view from a large face, another embodiment of a motor vehicle door lock, FIG. 7, the motor vehicle door lock from FIG. 6 in a view from a narrow side, FIG. 8, in a view in the opening direction, a lock hinge guideway for a motor vehicle door lock according to FIG. 6, FIG. 9, the lock hinge guideway from FIG. 8 in a view from above, FIG. 10, in a view in highly diagrammatic representation, otherwise similar to FIG. 3, an embodiment of a motor vehicle door lock according to the invention with pyrotechnic emergency release of the lock pawl, FIG. 11, a lock hinge for a motor vehicle door lock according to the invention with pyrotechnic emergency release, FIG. 12, another embodiment of a lock hinge for a motor vehicle door lock according to the invention also with pyrotechnic emergency release, FIG. 13, diagrammatically, two alternatives (*a; b*) of a combination of catch pawls and lock hinges that replace the combination of rotary bolt, lock pawl and lock hinge.

Central control electronics 1, which are supplied by the motor vehicle battery, not represented, is provided in the embodiment represented with an additional reserve battery 2 or another electrical energy storage device for an emergency, so that it remains able to function even if the other motor vehicle electrical system fails, for example in an accident. Control signals that reach a receiver 4 on outer door handle 5 on the motor vehicle chassis are transmitted by a portable transmitter 3 (electronic key/Smart Card) carried by the driver. Receiver 4 is connected to control electronics 1. Outer door handle 5 with its recessed grip 6 transmits only one electrical control signal to control electronics 1. Mechanical connections are no longer provided. Likewise, inner door handle 7 transmits only electronic signals generated by suitable microswitches to control electronics 1, and in the embodiment represented specifically from recessed grip 8, an opening signal and optionally also a disengaging signal and from securing button 9, a securing signal.

Actual motor vehicle door lock 10, which can also be a lock for a rear door or trunk lid, has only very few mechanical parts left. First of all it has an outer housing 11 closed on all sides that will usually consist of plastic, for example of two half shells that are assembled, sealed. Outer housing 11 has an entry slot 12 for the lock hinge, not shown. For this and further explanation, FIG. 2 of the drawing is also referenced. A rotary bolt 13 placed in housing 11 moves in entry slot 12. The bolt is kept in the locked position by a lock pawl 14 placed in housing 11, as is completely usual in door lock design. An electric drive 15 for lock pawl 14 is located in outer housing 11, and the drive thus causes the raising of lock pawl 14 out of the catch of rotary bolt 13 to open door lock 10.

The embodiment represented involves, for drive 15, an electric drive motor that interacts, by gears 16, with a threaded spindle 17 and threaded rod 18 to operate lock pawl 14. Many other alternatives, for example with an electromagnet (solenoid), are known from the prior art. Let that be pointed out.

Outside on housing 11 there is an electrical connection device 19 for the electrical connections of drive 15 and microswitches 20 that are in housing 11. Microswitches 20 can, for example, directly detect the position of lock pawl 14 and the position of rotary bolt 13, but can also assume other additional functions, for example determine an overheating of the motor of drive 15 or the like. Microswitches 20 can be electromechanical microswitches. But known nowadays are microswitches 20 that can be operated without contact, for example according to the Hall principle or those that work capacitively or inductively, or those that are optoelectronic.

It can be provided that all strip conductors to electrical connection device 19 be cast in the plastic material of housing 11, as is known for suitable housing parts from the prior art. In any case electrical connection device 19 is connected by a suitable electrical connection cable 21 or a suitable bus system to control electronics 1. The same applies to the other subassemblies of the locking unit.

According to the invention it is now provided that housing 11 is completely closed (totally encapsulated) externally except for entry slot 12 for the lock hinge. This improves protection against theft and moisture and exploits the possibilities of the known concept of the electronically controlled motor vehicle door lock to the fullest extent.

Concerning the electronic control function of a motor vehicle door lock of the type in question, the disclosed contents of EP-A-0 589 158 may also be mentioned, which will also fully be turned into the disclosed contents of this patent application.

Figure 2:
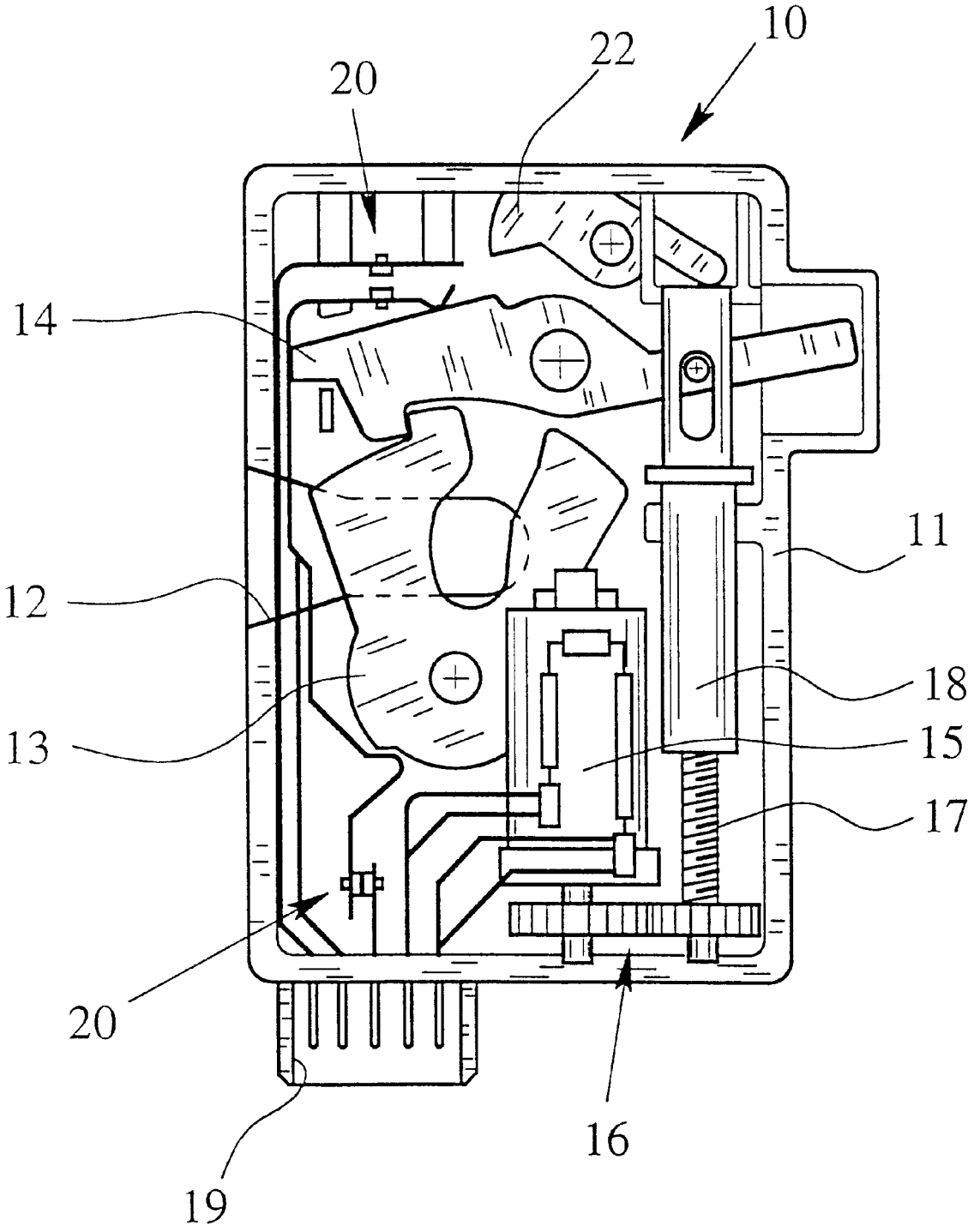

The embodiment represented in FIGS. 1 and 2 of a motor vehicle door lock is distinguished by another antitheft protection measure. The overall concept itself offers a high level of antitheft protection anyway because even after a violent break-in into the vehicle, for example by breaking a window pane, the motor vehicle door locks cannot be unlocked since the microswitches on inside door handle 7 would have been rendered inoperable by control electronics 1. By encapsulating rotary bolt 13 and lock pawl 14 with drive 15 in housing 11, lock pawl 14 cannot be acted upon either, even mechanically. But theoretically entry slot 12 still offers a break-in possibility. For this purpose, in the embodiment represented in FIGS. 1 and 2, another particular antitheft protection measure has been taken, namely an antitheft protection lever 22 is placed in housing 11, pretensioned in the direction of the raised position and blocking, in the engaged position, lock pawl 14 in its engaged position, and the lever can be brought by drive 15 into engaged position by a movement that is opposite the opening movement for lock pawl 14. An antitheft protection lever 22 for lock pawl 14 is nothing new in and of itself (DE-A-42 28 235), particular here however is the use of the overall concept using drive 15 to operate antitheft protection lever 22. It can be seen in FIG. 2 that a further upward movement of threaded rod 18 relative to the position in FIG. 2 pushes the lever arm of antitheft protection lever 22, lying on the right, upward and lets the left-side latch projection of antitheft protection lever 22 engage in a catch recess on the top side of lock pawl 14. Thus lock pawl 14 is blocked in case of break-in attempts.

Basically it would be possible to achieve the blocking only by the tang and slot on threaded rod 18. But then the breaking forces would act directly on threaded rod 18, which possibly could also be made as a plastic part. Antitheft protection lever 22 itself offers a considerably higher resistance to break-in attempts.

Figure 5:
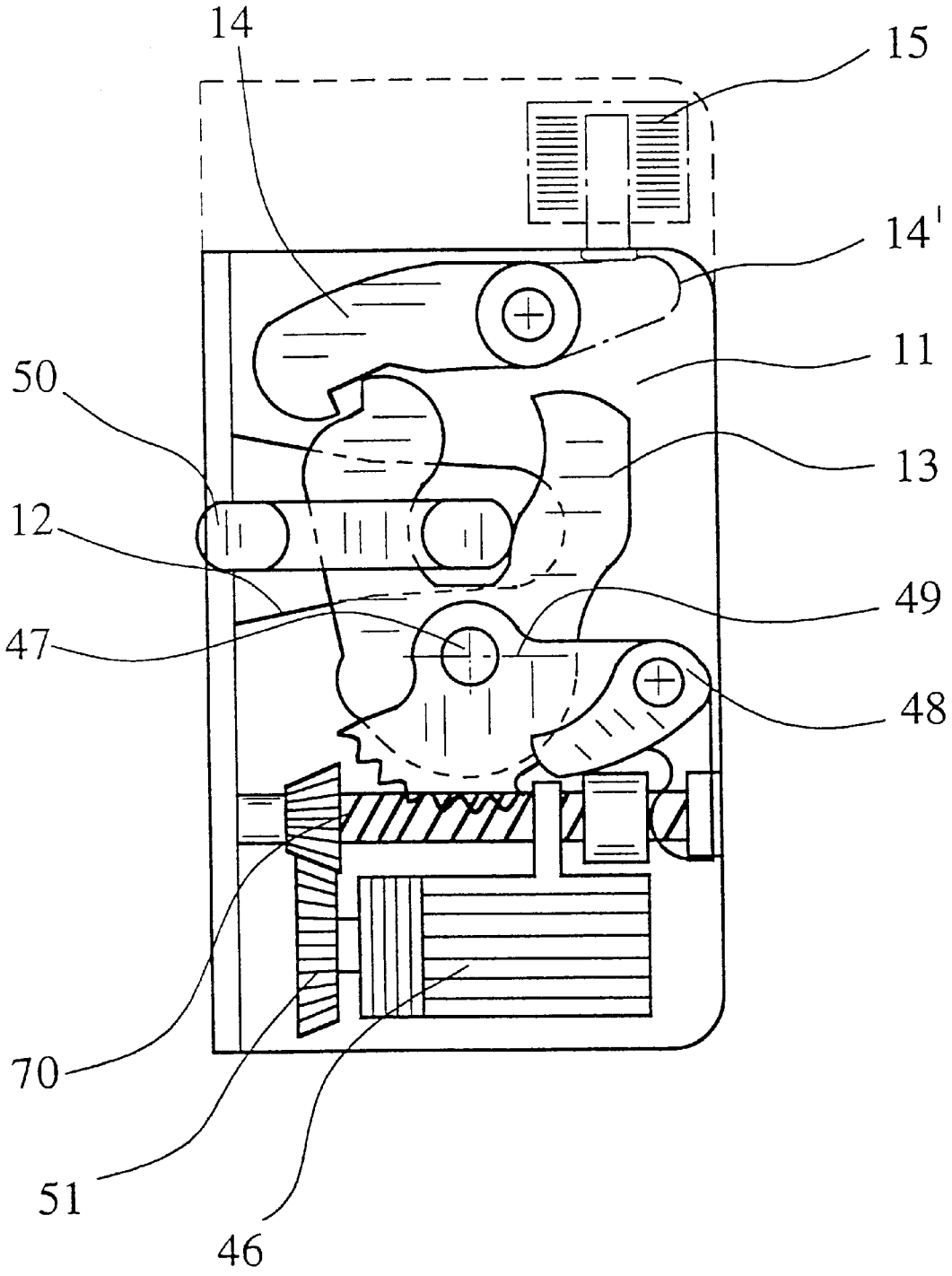

In the above explanation it has already been mentioned that drive 15 does not absolutely have to be configured as in the embodiment represented as an electric drive motor. Lock pawl 14 could also be driven directly by a solenoid. This is indicated in FIG. 5 in dashed lines as an alternative. The electromagnet (solenoid) here engages on a control arm 14' of lock pawl 14. In both cases lock pawl 14 could be kept constantly raised when rotary bolt 13 is open, so that noise disturbance stops. But a drive 15 operating according to the representation with gears 16 is relatively slow to react. A solenoid is faster, so that this concept can be used primarily for a solenoid as drive 15 for lock pawl 14.

Figure 3:
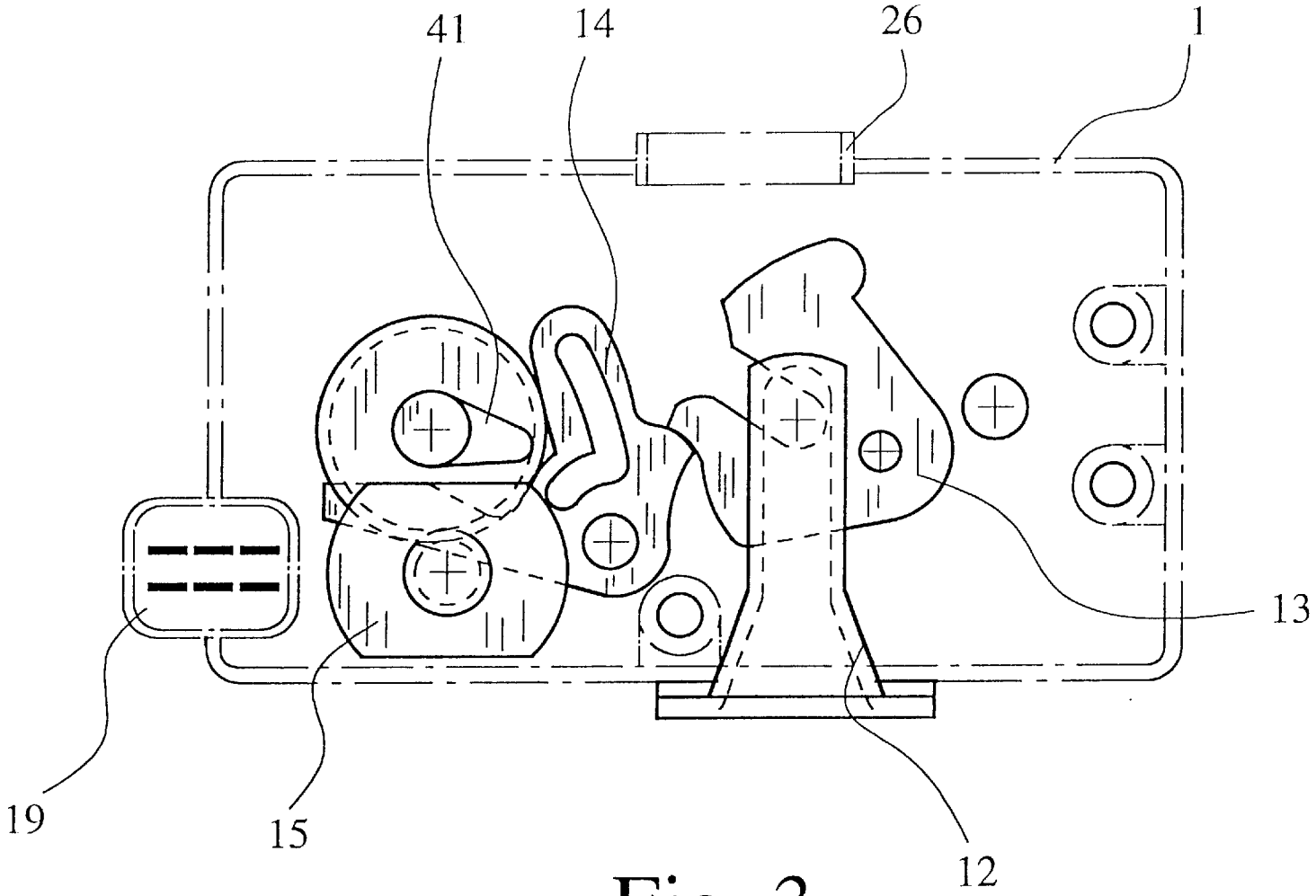

The embodiment in FIG. 3 shows a likewise fully encapsulated door lock 10 for a motor vehicle rear door that does not require special opening elements.

Figure 4:
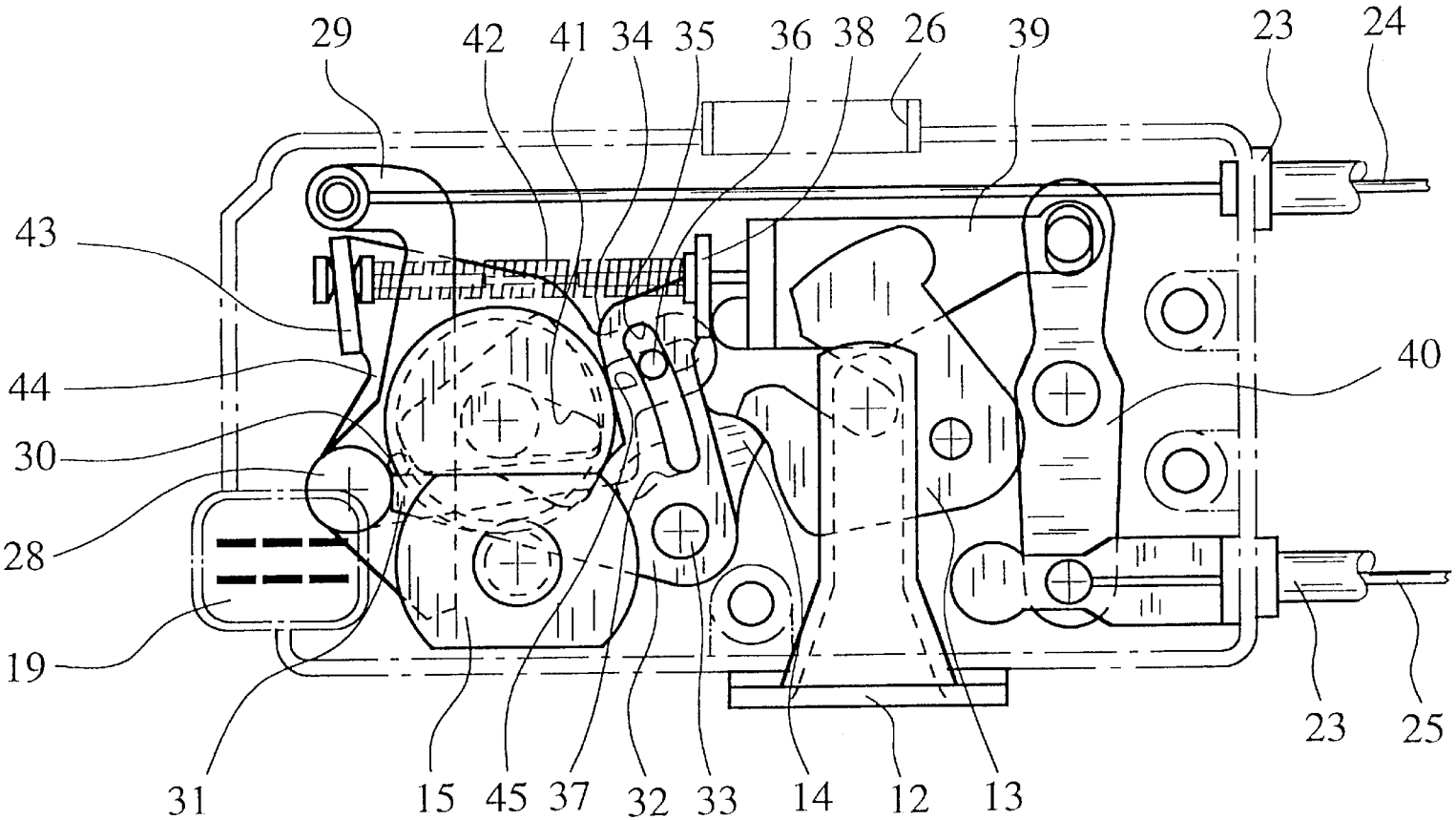

The embodiment in FIG. 4 shows a motor vehicle door lock 10 for a driver's door that is equipped with an additional possibility for mechanical operation (master lock, controls slave locks). Here it is provided in the embodiment represented that entry fittings 23 are provided on housing 10 for a first Bowden cable 24 for external opening and a second Bowden cable 25 for internal operation (locking, unlocking, opening). These entry fittings 23 for the Bowden cable do not fundamentally change anything about the concept of full encapsulation by outer housing 11, since these entry fittings 23 can be made to be completely sealing. Indicated in FIG. 4 is also an entry fitting 26 for the direct insertion of a lock cylinder, not shown, for example by attaching this outer housing 11 to a rear door of a dual purpose vehicle.

The concept of the embodiment represented is also useful because the motor vehicle door lock represented here is built very flat since the lever elements are placed right and left (or above and below) rotary bolt 13 and lock pawl 14. This concept takes on greater significance later in connection with another teaching of the invention that itself is independent.

In particular it can be seen that first Bowden cable 24 acts on an opening lever 29 mounted on entire axis of rotation 28. If the lever is pivoted clockwise when Bowden cable 24 is pulled, then a driver nose 30 comes to lie on driver arm 31 of a transmission lever 32 and entrains the latter downward in FIG. 4. Transmission lever 32 pivots here around axis 33. A transmission arm 34 projecting upward with slot link 35 pivots counterclockwise around axis 33. The position represented in FIG. 4 shows the released position. Here a transmission cog 36 is in the upper area of slot link 35. Actual lock pawl 14, whose placement on rotary bolt 13 can be recognized, is under transmission lever 32 in FIG. 4. Lock pawl 14 coincides in the area of transmission arm 34 with transmission lever 32. But it has an L-shaped slot link 37 that coincides in the long leg of the L with slot link 35, but near axis 33 the short leg of the L goes left. Projecting from transmission arm 34 of transmission lever 32 is a transmission angle 38 against which an inside opening lever 39 lies from the right in FIG. 4. If Bowden cable 25 in FIG. 4 is pulled rightward, then articulated lever 40 is pivoted around its central pivot axis and the top end, which is connected to inside opening lever 39, pivots in FIG. 4 leftward (counterclockwise). This pushes inside opening lever 39 against transmission angle 38 on transmission lever 32 and pivots it around axis 33 counterclockwise. The effect is thus the same as that exerted by opening lever 29 by driver nose 30 on transmission lever 32. Since transmission cog 36 is located above, in slot links 35, 37, lock pawl 14 is entrained and rotary bolt 13 is released.

The same function occurs if actuating cam 41, which is put into rotation by drive 15, strikes driver arm 31 of transmission lever 32, namely by turning clockwise out of the position in FIG. 4.

Securing of the motor vehicle door lock represented, that can also be actuated mechanically, is performed by pushing second Bowden cable 25. This pivots articulated lever 40 clockwise around the center axis. Inside opening lever 39 entrains, by spring element 42, a driver angle 43 on inside securing lever 44. The latter has on the right a crosswise slot link 45 in which transmission cog 36 runs. If inside securing lever 44 pivots around entire axis of rotation 28 clockwise, slot link 45 entrains transmission cog 36 downward in the direction of axis 33 of transmission lever 32 in the area of the short leg of the L of L-shaped slot link 37. This is then the secured position in which transmission lever 32 can be moved but has no effect on lock pawl 14, since transmission cog 36 moves, free-running, in the short leg of the L of L-shaped slot link 37.

The above-mentioned additional ability to actuate the motor vehicle door lock mechanically makes the production expense considerably higher of course. This basically contradicts the concept of the fully electronic design of motor vehicle door lock 10, but is sometimes unavoidable because of national requirements. But the modular design of this construction is useful. From a basic lock with a uniform outer housing 11, all conceivable variants can be equipped by adding standard components.

FIG. 5 shows an embodiment of the invention that is especially preferred because a drive motor 46 for motorized movement of rotary bolt 13 is placed in housing 11 and is engaged with the bolt also when it is in the locked position. Rotary bolt 13 is turned by drive motor 46 increasingly further in the locking direction as the travel speed of the motor vehicle increases. This is achieved structurally in the embodiment represented in that a bent crank 49 provided on a reference circle with a toothed segment and coupled to rotary bolt 13 by driver pawl 48 is mounted on axis of rotation 47 of rotary bolt 13. Bent crank 49 engages with the toothed segment by a threaded spindle 70 that is driven by drive motor 46 by gears 51. Depending on the travel speed, rotary bolt 13 turns further in the locking direction. To open the door lock driver pawl 48 must of course be raised to release the blocking of rotary bolt 13.

Figure 6:
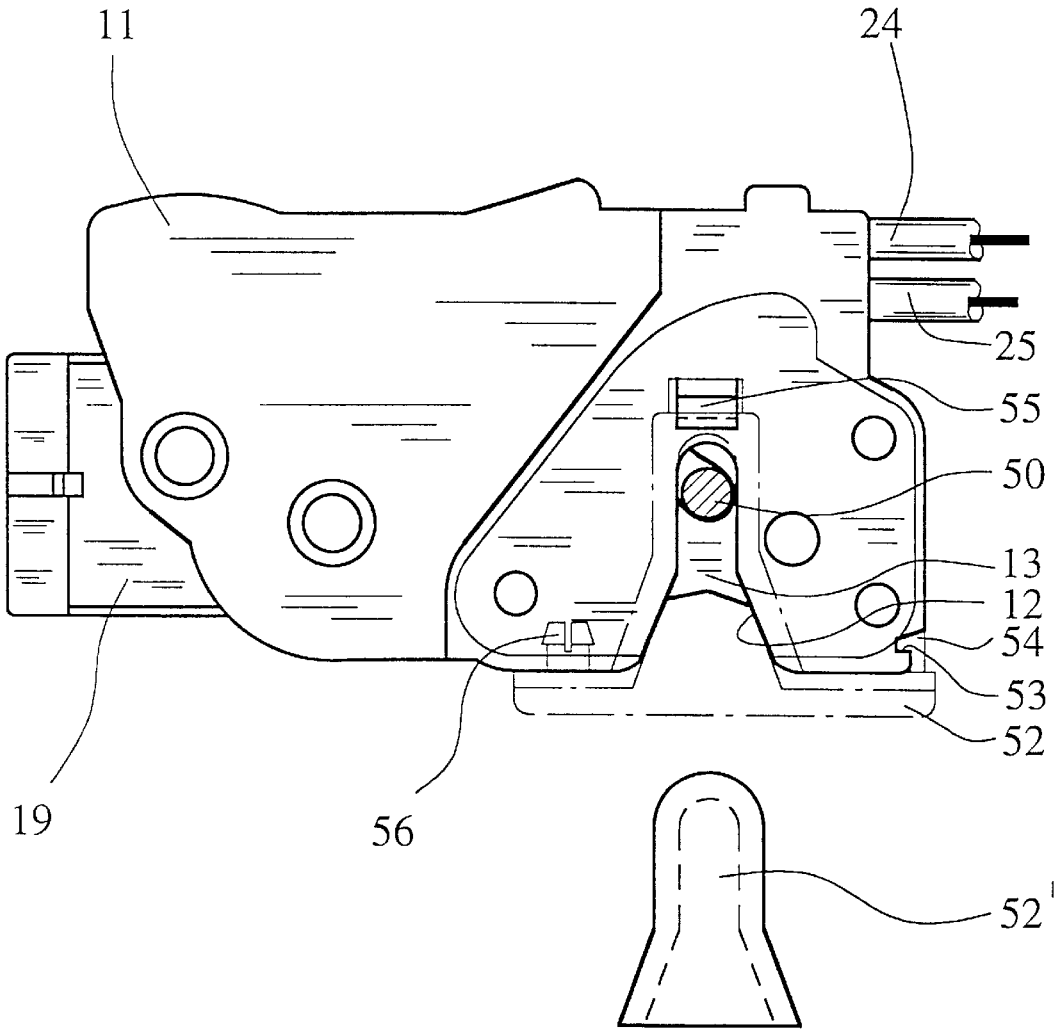
Figure 7:
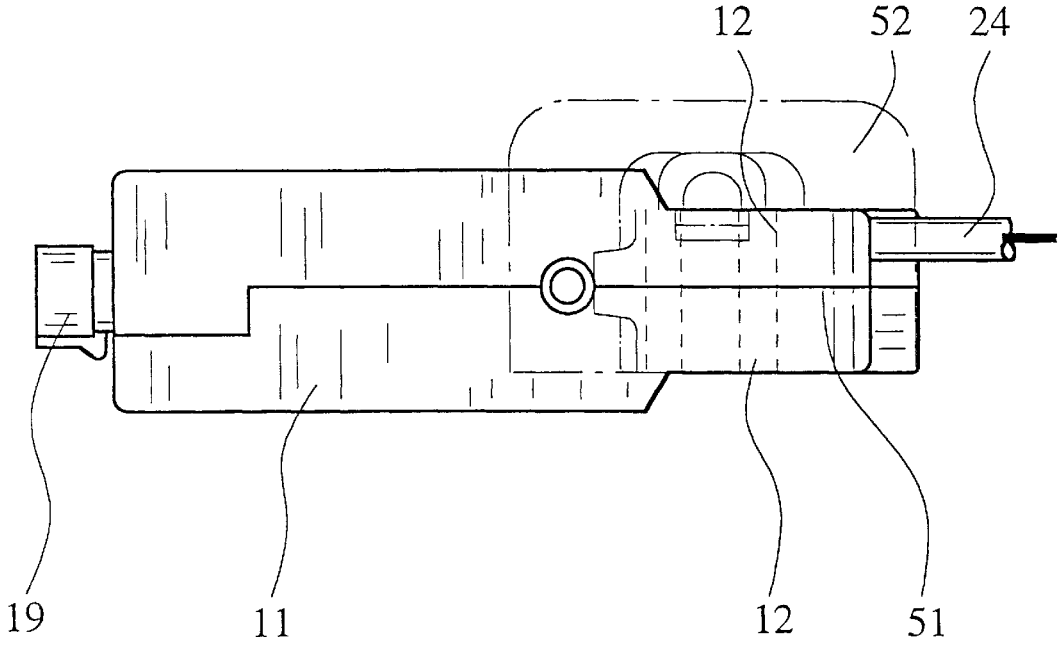

FIGS. 6 and 7 of the drawing show another embodiment of a motor vehicle door lock according to the invention that is distinguished in that it can be used alternatively for left entry, right entry, or center entry (rear door, rear lid). The concept of this motor vehicle door lock thus makes it possible to apply this motor vehicle door lock universally so that this motor vehicle door lock can be used also economically in smaller production runs of motor vehicles. The repeatedly explained components of this motor vehicle door lock are provided, as can be seen, with the reference symbols used before. Lock hinge 50, represented here for the first time, is added.

The above-explained motor vehicle door lock represented in FIGS. 6 and 7 is distinguished, according to the preferred and independent teaching of the invention, in that housing 11 is made essentially symmetrical to its center plane 51 lying in or parallel to the plane of rotary bolt 13 and lock pawl 14 and is provided on both large faces parallel to center plane 51 with an entry slot 12. Center plane 51 can be seen especially well in FIG. 7 because here also housing 11 consists of two half shells made of plastic, provided with metallic reinforcement plates, and clipped to one another.

The above-explained design of the motor vehicle door lock according to the invention with an entry slot 12 on each large face of housing 11 makes it possible to have problem-free installation of the door lock for left entry of lock hinge 50 or right entry of lock hinge 50 or for center entry of lock hinge 50 for example on a rear door or rear lid. One and the same motor vehicle door lock can thus finally be used for all door and lid locks, even for a lock on the engine hood. Also smaller production runs of motor vehicles can be equipped economically with this motor vehicle door lock, since the piece number is at least doubled compared to previously known concepts.

It has already been indicated above that the fact that the motor vehicle door lock according to the invention is or can be built very flat if the levers inside housing 11 are arranged correctly has special significance. The embodiment represented according to FIG. 6 and especially FIG. 7 shows this. For the integration of the above-mentioned Bowden cables 24, 25 it is provided here that they exit, with their entry fittings 23, a narrow side of housing 11. Thus in principle nothing changes about the position of Bowden cables 24, 25 when using the motor vehicle door lock for left entry or right entry. They always exit housing 11 in the direction of center plane 51.

At the bottom of FIG. 6 it is additionally indicated, as a separate part, that a cap 52' matched to the shape of entry slot 12 can be provided as a separate component. This cap 52' can be attached to housing 11 to close entry slot 12 when not in use and in which then, in the installation position of housing 11 provided, lock hinge 50 does not enter. Specifically, this cap 52' can be pushed into entry slot 12 and snapped in it onto housing 11. Cap 52' is delivered along with the delivery of the motor vehicle door lock and attached, during installation in the motor vehicle door, to housing 11 at suitable entry slot 12 that is not being used. Thus housing 11 is fully closed except for entry slot 12 used for entry of lock hinge 50.

Figure 8:
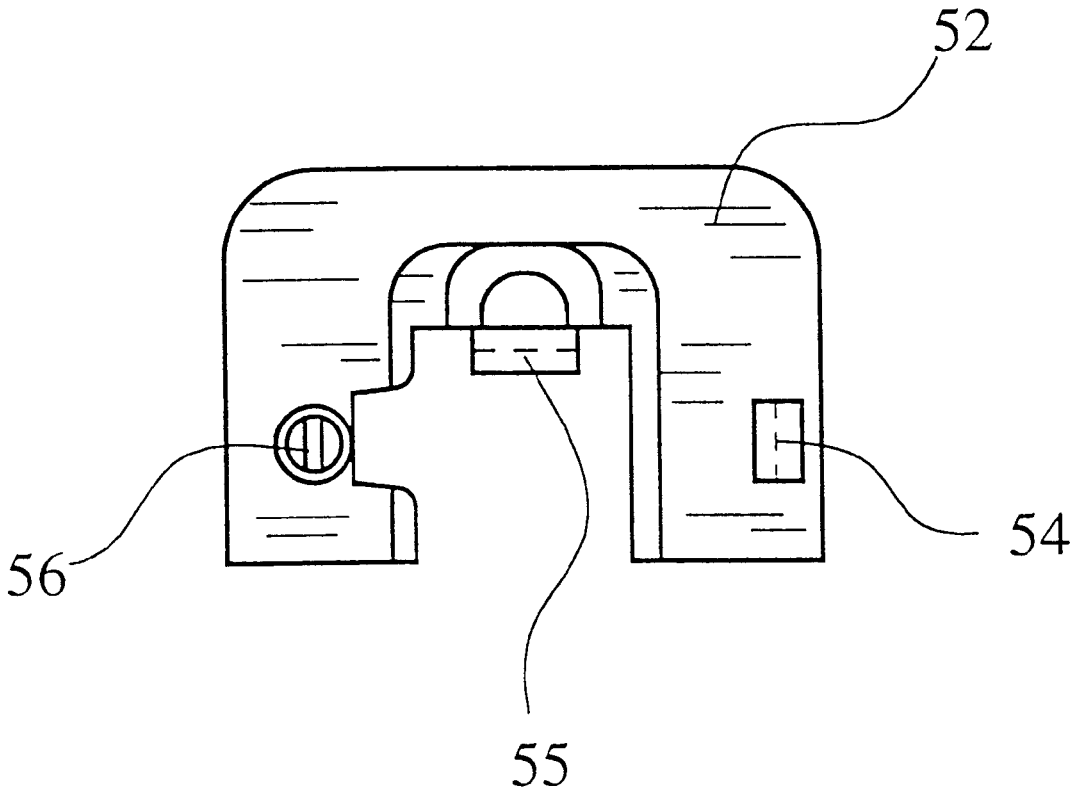
Figure 9:
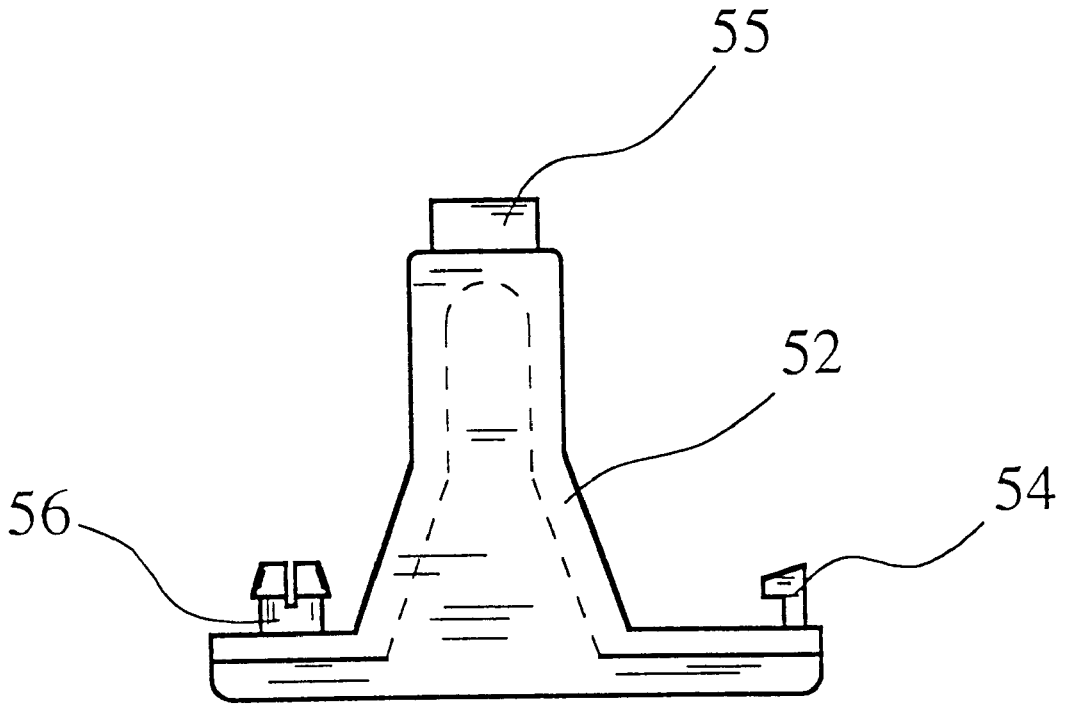

In FIG. 6 and FIG. 7 it is further indicated in dot-dash lines how a component that is represented in FIG. 8 and FIG. 9 can be attached to housing 11 of the motor vehicle door lock according to the invention. Sometimes it is namely necessary to provide an additional lock hinge guideway 52 for lock hinge 50. Such lock hinge guideways have been known from the prior art for a long time, arc-shaped or wedge-shaped guideways are known here, guideways with supporting rocker arms or the like. The prior art on this is extensive. Most of such lock hinge guideways consist of plastic and are integrated as a component in housing 11.

A lock hinge guideway 52 should normally guide lock hinge 50 on three sides, not only upward and downward (with vertical installation of the motor vehicle door lock as is usual on a side door). In particular for this reason, but also for installation reasons, it is provided in the proposed concept that a lock hinge guideway 52 allocated to entry slot 12 is provided as a separate component, in mirror symmetry to a plane and attachable to housing 11 alternately on one of the two large faces. As an alternative (this is represented in FIGS. 8 and 9) it can be provided that lock hinge guideways 52 allocated to entry slots 12 are provided as separate components, one to attach to one large face and the other to attach to the other large face, and finally that one of two lock hinge guideways 52 can be attached to the appropriate large face of housing 11. FIGS. 8 and 9 show this version of lock hinge guideway 52, to be produced separately in each case for left entry and right entry, FIGS. 6 and 7 show this lock hinge guideway 52 in the one alternative in dot-dash lines in the position attached to housing 11.

The embodiment represented is characterized in that lock hinge guideway 52 can be snapped on housing 11. As is usual in the prior art for other lock hinge guideways, lock hinge guideway 52 consists of thermoplastic plastic in the embodiment represented.

In the embodiment represented it is further provided that housing 11 is provided with catch recesses 53 for molded catches 54, 55, 56 on lock hinge guideway 52. Here it is provided according to preferred teaching that catch recesses 53 be placed on a narrow side of housing 11 and be usable for both positions.

It can be seen on the lower narrow side of housing 11 in FIG. 6 on the right that there is a groove-shaped catch recess 53 for hook-shaped molded catch 54 on lock hinge guideway 52, about in the middle above lock hinge 50 there is another catch recess 53 for likewise hook-shaped molded catch 55 in the middle on lock hinge guideway 52 and in FIG. 6, not shown, but easily conceivable, there is another catch recess on lock hinge guideway 52 for molded catch 56, designed as a tenon.

With lock hinge guideway 52, which is clipped subsequently on housing 11, a preferred sealing of entry slot 12 against the entry of moisture can be performed. Where and how lock hinge guideway 52 is connected to housing 11 remains up to the respective production department. This can be done at the lock producer or at the motor vehicle producer during assembly on the assembly line.

Figure 10:
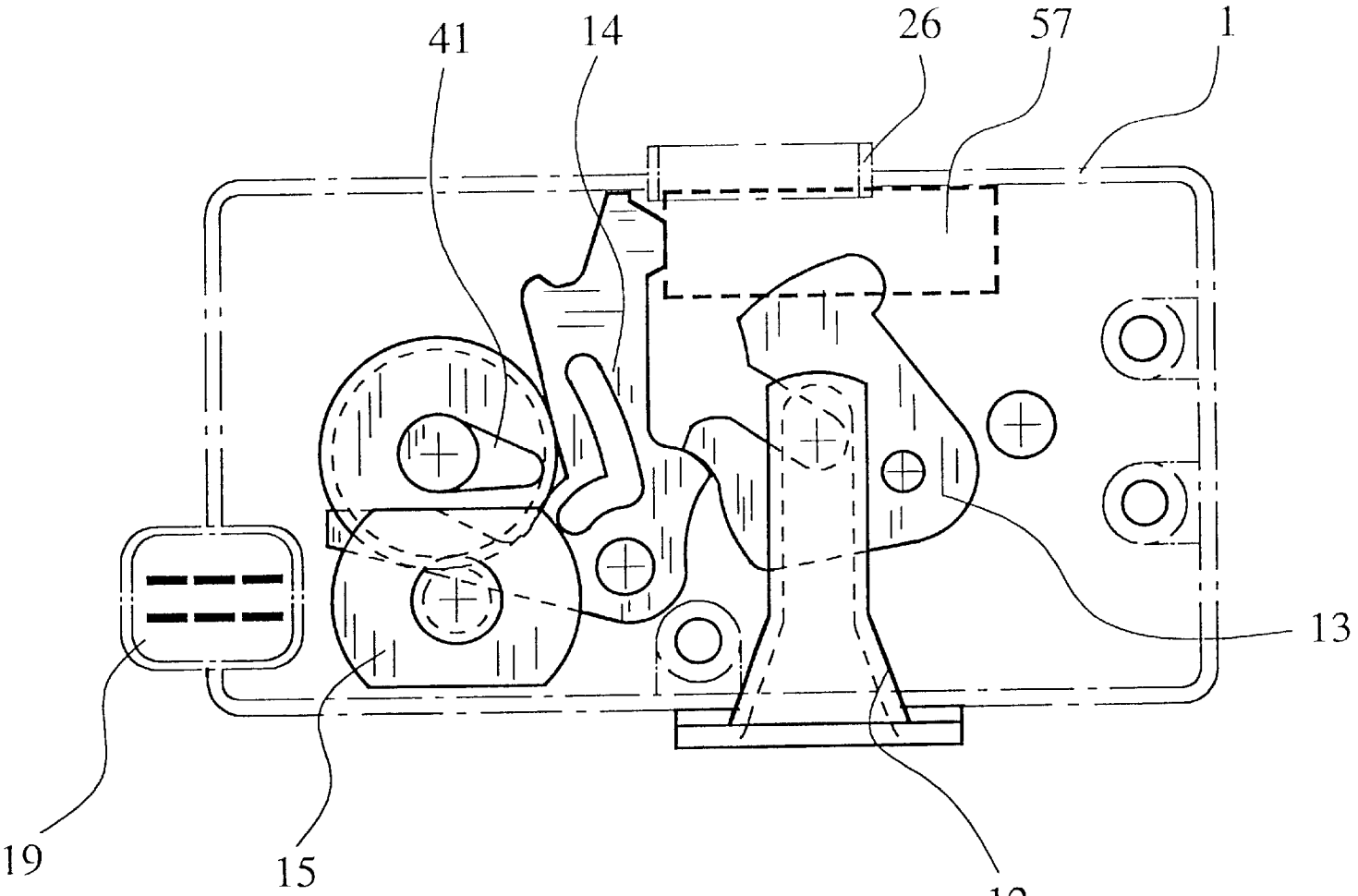

FIG. 10 shows another, again independent teaching of the invention that is oriented toward emergency release of the motor vehicle door lock. The same parts also have the same reference symbols as before.

Emergency release is a central safety feature in the proposed concept of a motor vehicle door lock system. Here it is now provided that lock pawl 14 in housing 11 is assigned an emergency drive in the form of a pyrotechnic cartridge 57 that can be ignited in a controlled way in an emergency and shifts lock pawl 14 into the opening position. If all electrical systems fail after the vehicle stops in case of an accident, such a pyrotechnic cartridge can automatically be ignited. Pyrotechnic cartridges of this type are known for example from belt tighteners.

Figure 11:
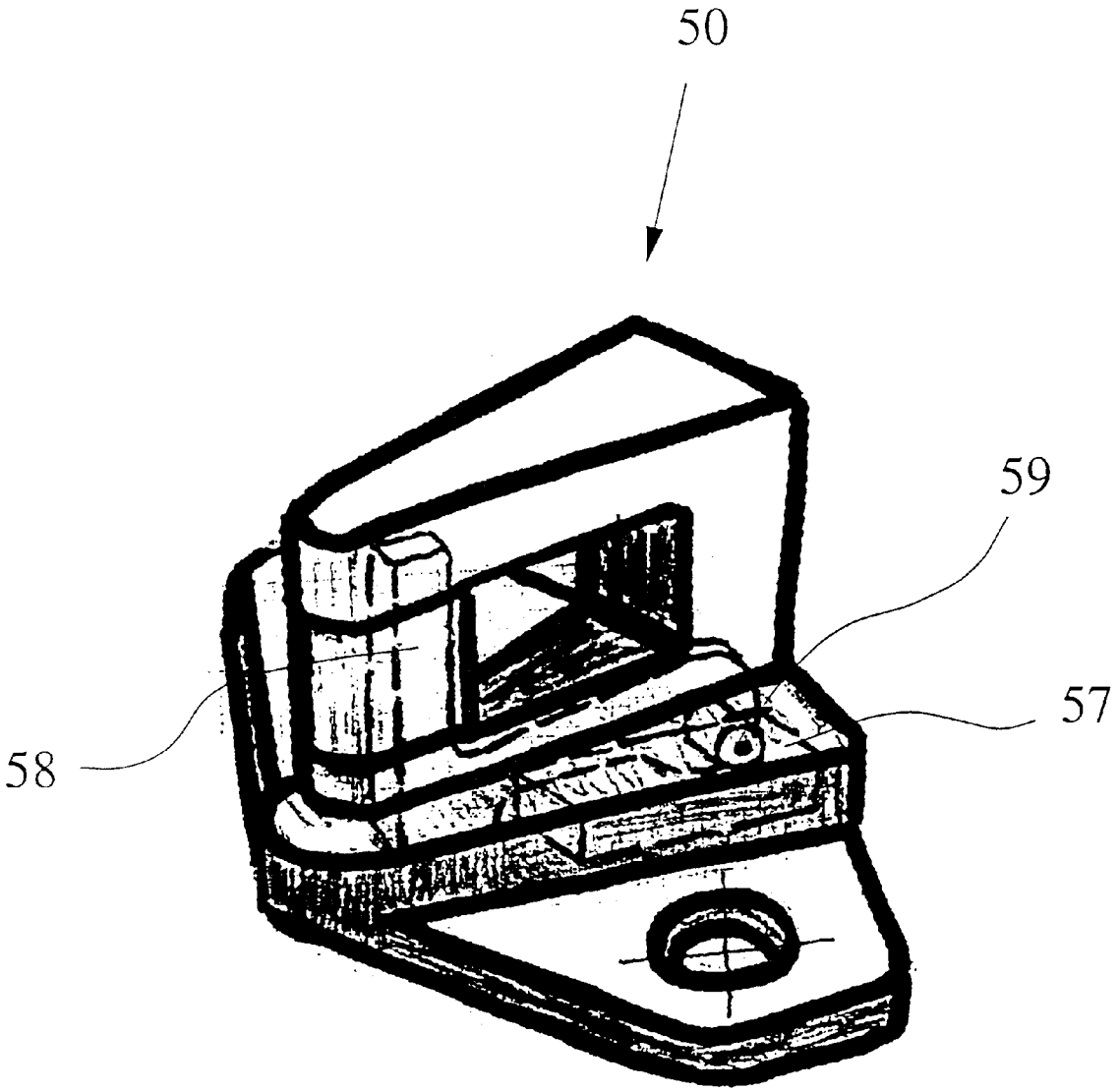
Figure 12:
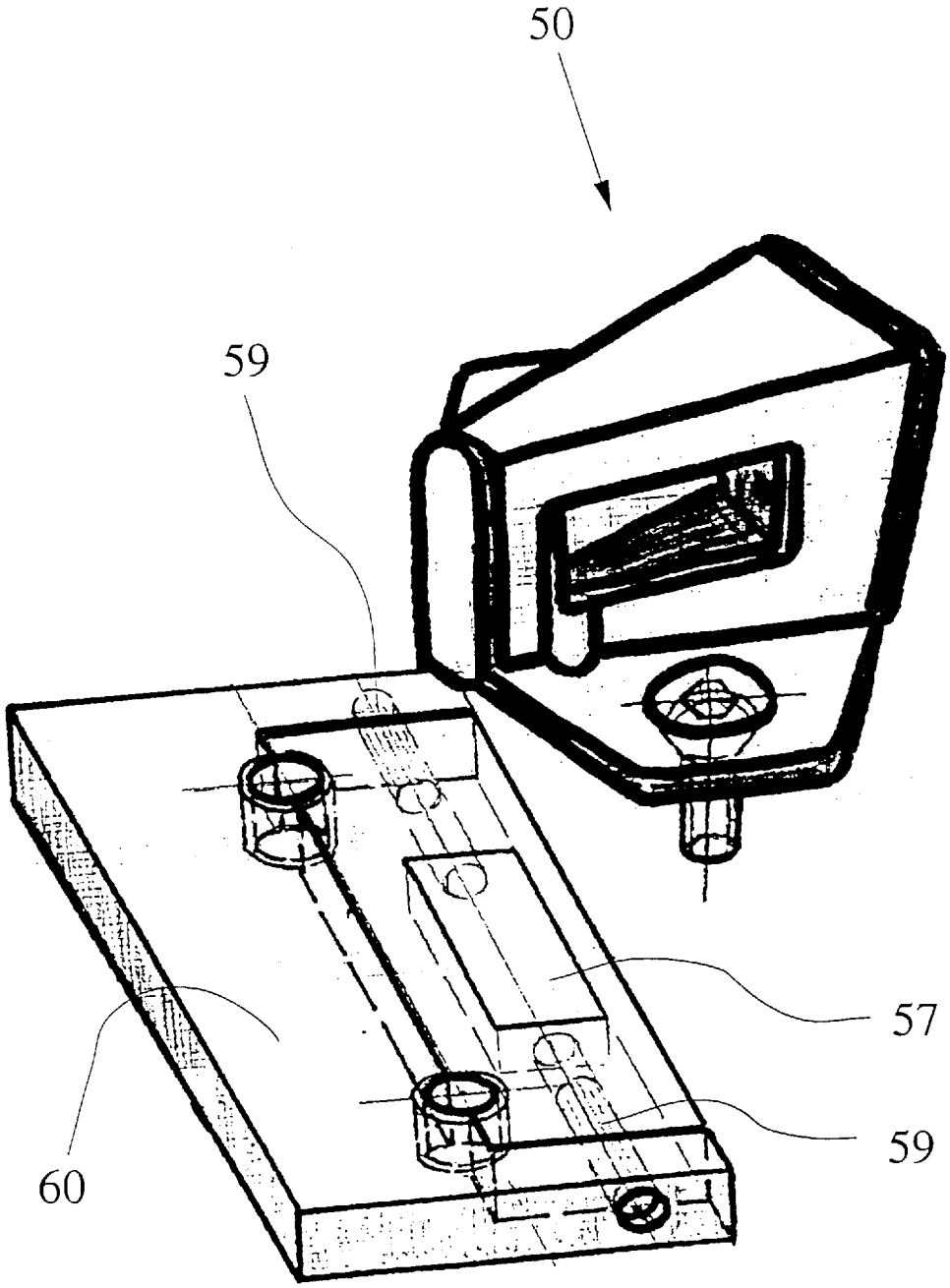

The pyrotechnic emergency release concept specifically for motor vehicle doors has a different configuration in the embodiments of FIGS. 11 and 12. In the embodiment according to FIG. 11 it is provided that lock hinge 50 has an emergency drive, specifically a pyrotechnic cartridge 57, that can be ignited in a controlled way in an emergency and release at least the part of lock hinge 50 that holds rotary bolt 13. Here it is provided that lock hinge 50 has a catch lever 58 with an adjustable bearing bolt 59 and that bearing bolt 59 is pushed out of the corresponding bearing by emergency drive 57, i.e., specifically pyrotechnically triggered.

As an alternative to this it is provided in the embodiment according to FIG. 12 that lock hinge 50 is fastened by bearing bolts 59 to a bearing plate 60 that, for its part, is fastened to the chassis and that bearing bolts 59 are released, specifically pyrotechnically, by an emergency drive 57, from the corresponding bearings on bearing plate 60.

Both of the above-mentioned variants have in common that the emergency release is performed in an emergency by detaching lock hinge 50 from the chassis, for example from the B-pillar or C-pillar of the chassis and, remaining in the motor vehicle door lock itself, is entrained with the motor vehicle door when it is opened.

The above mentioned engine hood closure that can be opened with a key and that has its own significance in the overall system of the motor vehicle door locks according to the invention has the further advantage that, in case of current failure, the engine compartment can easily be reached by a key. Thus battery or central electronics can be reached or also from inside the engine compartment a mechanical emergency opening can be performed.

Above it has constantly been indicated that the emergency drive is a pyrotechnic cartridge 57. Basically it is of course possible to provide, also for lock hinge 50 or its corresponding parts, another emergency drive, for example in the form of a solenoid. The problem here is only the dependence on energy. Thus for this emergency opening or emergency release there is the considerable advantage of the pyrotechnic emergency drive or also a simple hand operation from the outside.

Figure 13:
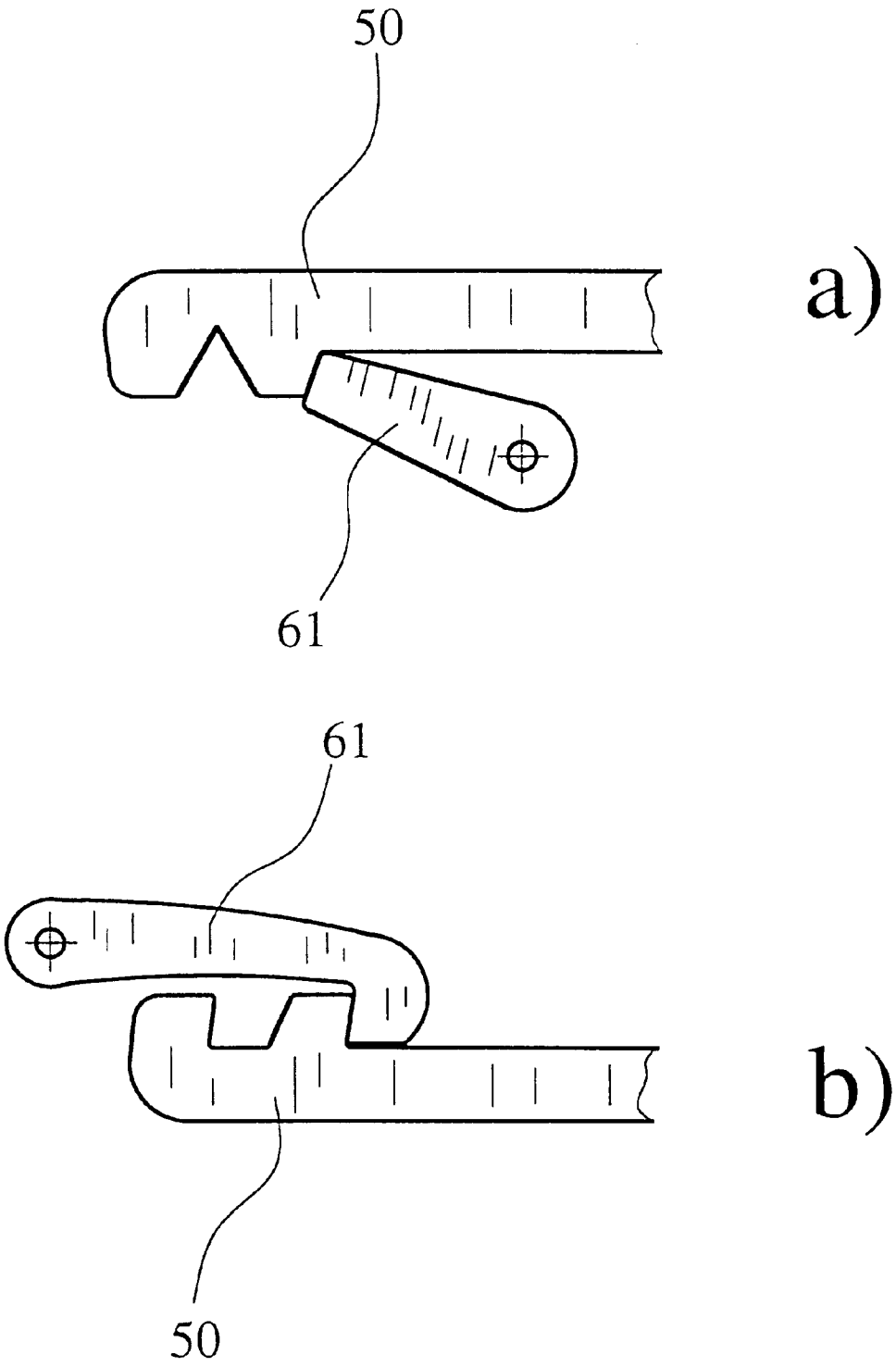

Besides motor vehicle door locks, in which a rotary bolt 13 is kept in its locked position by a lock pawl 14, motor vehicle door locks are also known in which, instead of the combination of rotary bolt 13 and lock pawl 14, only one catch pawl 61 is provided that interacts directly with a lock hinge 50 that has corresponding notching. The teaching of the invention can also be applied to a motor vehicle door lock made this way, to which claim 17 refers. Instead of a suitable locking or actuation of lock pawl 14 there is then a suitable locking or actuation of single catch pawl 61. FIG. 13 shows this structural alternative to a rotary bolt lock in two variants. FIG. 13*a* shows such a rocking bolt lock with lock hinge 50 and a catch pawl 61 that locks by hooking from above, i.e., when stressed by tension.

I claim:

1. Motor vehicle lock comprising an outer housing having a pair of opposed large faces, each of which is provided with an entry slot for a lock hinge, a rotary bolt located in said housing and movable within the entry slots, a lock pawl located within said housing for holding the rotary bolt in a locked position, an electric drive located in said housing for moving said lock pawl, and an electrical connection device for electrically connecting said drive to a source of electrical power; wherein said housing is essentially symmetrical relative to a center plane thereof that lies parallel to a plane of rotation of the rotary bolt with the entry slots being elongated in essentially identical directions that are parallel to said center plane on opposite sides thereof; and wherein said electric drive is positioned between said entry slots, the symmetry of the housing and the positioning of the entry slots and electric drive enabling mounting of the housing, selectively, at either of said opposed large faces for use at both left and right sides of a vehicle.

2. Motor vehicle lock according to claim 1, wherein an entry fitting for at least one Bowden cable is provided on a narrow side of the housing provided between said opposed large faces.

3. Motor vehicle lock according to claim 1, wherein a cap that is matched to the shape of the entry slots is provided as a separate component which is fastenable on the housing for closing a one of the entry slots which is not in use.

4. Motor vehicle lock according to claim 3, wherein said cap is insertable into said one of the entry slots.

5. Motor vehicle lock according to claim 3, wherein said cap is snappable onto said housing.

6. Motor vehicle lock according to claim 3, wherein a lock hinge guideway is provided as a separate component which is mountable to said housing in association with an other of the entry slots which is in use, said lock hinge guideway being mirror symmetric with respect to a plane passing therethrough.

7. Motor vehicle lock according to claim 3, wherein lock hinge guideways are provided for each of the entry slots as separate components, one for placement on one of the large faces and the other for placement on the other of the large faces.

8. Motor vehicle lock according to claim 6, wherein the lock hinge guideway is snappable onto the housing.

9. Motor vehicle lock according to claim 6, wherein the lock hinge guideway is made of a thermoplastic plastic material.

10. Motor vehicle lock according to claim 7, wherein the housing is provided with catch receptacles for molded catches on the lock hinge guideway.

11. Motor vehicle lock according to claim 10, wherein the catch receptacles are on a narrow side of the housing.

12. Motor vehicle lock according to claim 1, wherein the large faces are separated by narrow peripheral edge faces; and wherein a metal reinforcement plate is provided on each large face of the housing, parallel to said center plane.

13. Motor vehicle lock according to claim 1, wherein the electrical connection device is located on an outer side of said housing.

14. Motor vehicle lock according to claim 1, wherein the housing is completely closed externally except for said entry slot for the lock hinge and any entry fittings for at least one of a lock cylinder and Bowden cables.

15. Motor vehicle lock comprising an outer housing having a pair of opposed large faces, each of which is provided with an entry slot for a lock hinge having a catch, a catch pawl located in said housing which interacts directly with the catch of the lock hinge having a corresponding catch, and an electric drive located in said housing for moving said catch pawl, and an electrical connection device for electrically connecting said drive to a source of electrical power; wherein said housing is essentially symmetrical relative to a center plane thereof that lies parallel to a plane of rotation of the catch pawl with the entry slots being elongated in essentially identical directions that are parallel to said center plane on opposite sides thereof; and wherein said electric drive is positioned between said entry slots, the symmetry of the housing and positioning of the entry slots and electric drive enabling mounting of the housing, selectively at either of said opposed large faces for use at both left and right sides of a vehicle.

16. Motor vehicle lock according to claim 15, wherein the electrical connection device is located on an outer side of said housing.

17. Motor vehicle lock according to claim 15, wherein the housing is completely closed externally except for said entry slot for the lock hinge and any entry fittings for at least one of a lock cylinder and Bowden cables.

* * * * *